United States Patent [19]

Bello et al.

[11] 4,264,335

[45] Apr. 28, 1981

[54] SUPPRESSING THE OCTANE REQUIREMENT INCREASE OF AN AUTOMOBILE ENGINE

[75] Inventors: Charles Bello, Harrison Township, Allegheny County; Robert J. Hartle, Gibsonia; Gary M. Singerman, Monroeville, all of Pa.

[73] Assignee: Gulf Research & Development Company, Pittsburgh, Pa.

[21] Appl. No.: 85,052

[22] Filed: Oct. 15, 1979

Related U.S. Application Data

[63] Continuation-in-part of Ser. No. 957,564, Nov. 3, 1978, abandoned.

[51] Int. Cl.[3] ..... C10L 1/18; C10L 1/30

[52] U.S. Cl. ..... 44/68; 252/386

[58] Field of Search ..... 44/68, 67; 252/386

[56] References Cited

U.S. PATENT DOCUMENTS

| | | | |
|---|---|---|---|
| 1,692,784 | 11/1928 | Orelup | 44/68 |
| 2,546,421 | 3/1951 | Bartholomew et al. | 44/68 |
| 2,737,932 | 3/1956 | Thomas | 44/68 |
| 3,057,153 | 10/1962 | Rocchini et al. | 44/68 |

*Primary Examiner*—Winston A. Douglas
*Assistant Examiner*—J. V. Howard

[57] ABSTRACT

The octane requirement increase of a gasoline fired internal combustion engine is suppressed by the incorporation in the gasoline fed to the engine of a minor amount of cerium (III) or cerium (IV) 2-ethylhexanoate.

6 Claims, No Drawings

SUPPRESSING THE OCTANE REQUIREMENT INCREASE OF AN AUTOMOBILE ENGINE

This is a continuation-in-part of U.S. patent application Ser. No. 957,564, filed Nov. 3, 1978, now abandoned.

SUMMARY OF THE INVENTION

This invention relates to the suppression of the tendency of gasoline fired internal combustion engines to require an increase in the octane rating of the gasoline after substantial use in order to prevent engine knocking. This suppression is accomplished by the incorporation in the motor gasoline of cerium (III) or cerium (IV) 2-ethylhexanoate.

DESCRIPTION OF THE INVENTION

New automobile engines possess a specific measurable octane requirement for the gasoline combusted in the engine. However, after the automobile has been driven a substantial distance, the octane requirement of the engine increases unless the gasoline contains a suitable additive to suppress this increase. As a result, a particular grade of motor gasoline which is suitable with a new engine may cause severe knocking after several hundred hours of engine use, requiring one or more switches to more costly, higher octane fuels as the engine's octane requirement increases with use. It is the purpose of this invention to significantly reduce such requirement for an increase in octane by gasoline powered automobile engines.

U.S. Pat. No. 1,692,784 states that esters, amides, halogenated derivatives and metallic salts of fatty acids are useful as gasoline additives for preventing carbon deposits in gasoline powered internal combustion engines. Included in this patent in the listed exemplifications of fatty acids is caprylic acid, also known as octanoic acid, and included in the list of metals is cerium. The additive must be soluble in gasoline and once dissolved it must not precipitate out. We have been unsuccessful in various attempts to dissolve cerous octanoate in gasoline. Therefore, we have concluded that cerous octanoate cannot suitably function as a gasoline additive.

However, we have surprisingly discovered that cerous 2-ethylhexanoate is soluble in gasoline and have discovered that although this compound has no effect on the antiknock characteristics of a motor gasoline, it does have a positive effect on the octane requirement increase of an automobile engine when incorporated in the gasoline combusted in that engine. For example, when cerous 2-ethylhexanoate is incorporated in a motor gasoline that causes knocking in a particular engine, the cerium compound will not reduce the knock producing characteristics of the gasoline such as would result with an equivalent quantity of tetraethyl lead. However, if cerous 2-ethylhexanoate is introduced into a motor gasoline that does not cause knocking in a particular engine, the tendency of that engine to knock with prolonged use of the fuel containing this cerium carboxylate additive is substantially reduced. This result occurs because this particular cerium compound partially suppresses the inherent tendency of an automotive engine to require a higher octane gasoline after a substantial period of use. This inhibition of the octane requirement increase of an automotive engine is also obtained herein by the use of ceric 2-ethylhexanoate as an additive in the gasoline.

The cerium 2-ethylhexanoates can be used in the gasoline in an amount of about 0.05 to about ten grams per gallon of gasoline, and preferably from about 0.2 to about two grams per gallon of gasoline. It is not necessary that the cerium carboxylate modified gasoline be used in an engine when it is new in order to obtain the desirable suppression of the requirement for octane increase. If an automotive engine has been used over a substantial period of time with an unmodified fuel such that a substantial increase in the octane requirement of the engine has resulted, then this octane requirement increase can be significantly decreased after regular use of the cerium carboxylate modified fuel. For this reason, this cerium carboxylate additive can be used either periodically as needed, or it can be used continuously.

The cerium 2-ethylhexanoates can be effectively incorporated into a motor gasoline together with the other conventional gasoline additives including antiknock agents, such as manganese methylcyclopentadienyl tricarbonyl and tetraethyl lead.

The only significant effect that the cerium 2-ethylhexanoates have on the gasoline is the suppression of an increase in the octane requirements of the engine using the modified gasoline. They do not appear to improve the combustion efficiency of the motor fuel other than by their suppression of an increase in octane requirements of an engine utilizing the modified motor fuel. Thus, they do not have a significant effect on the uniformity of combustion. Furthermore, they do not improve the smoothness of the operation of the motor utilizing the additive-modified gasoline, nor is there an increase in speed or power of the engine except as a result of the suppression of an increase in the octane requirements. And neither does this cerium carboxylate-modified gasoline affect the rate of combustion or provide a decrease in fuel consumption for a given power level, nor does it permit the use of a leaner mixture of fuel, that is, permit a reduction in the fuel-air ratio.

DESCRIPTION OF PREFERRED EMBODIMENTS

In the following experiments the research method octane number (RON) was determined by ASTM D2700 and the motor method number (MON) was determined by ASTM d2699.

The experiments were carried out on two different 1976 Chevrolet engines having 305 cubic inch (5 liter) displacement. The engine was taken apart and cleaned before the start of each experiment. The octane requirement of the engine was then determined by the use of a series of reference motor fuels of slightly different octane ratings. In determining the octane requirement the engine was run at 1,400; 1,800 and 2,200 r.p.m. using a reference gasoline with gradual loading up to wide open throttle. The incipient knocking under these test conditions with a particular reference gasoline established the octane requirements of the engine.

The engine was then run under simulated normal, nonknocking conditions for an extended period such as 24 hours before the octane requirements of the engine are again determined as just described. This simulated normal driving involves a series of 10-minute cycles continually repeated between octane determinations over the entire period of each experiment. Each 10-minute cycle involves three phases. The first phase was a one-minute idle at 600–650 r.p.m. and no load. The second phase representing 25 m.p.h. (40 km.p.h.) was for four and one-half minutes at 1,200 r.p.m. and 20–25 pound feet (27.1–33.9 Nm) of load. The third phase representing 45 m.p.h. (72 km.p.h.), also for four and one-half minutes, was carried out at 1,750 r.p.m. and 45–50 pound feet (61.0–67.8 Nm) of load. Each experiment was carried out until the engine's octane requirements stablized as illustrated by the following data.

All of these experiments were carried out with a standard commercially available lead-free motor gasoline as the test fuel except for the use of the reference fuels which were used in determining the engine octane requirement, as described.

EXAMPLE 1

This experiment, carried out in engine No. I, was a blank run with no additive in the test gasoline. The octane requirement of the engine was initially 93 RON. After 24 hours the octane requirement was 94, after 48 hours it had increased to 98 and at 72 hours it was still 98. At 122 hours the octane requirement was found to be 100 and this requirement of 100 octane was repeated at 170 hours and 194 hours giving an average stabilized octane requirement of 100 RON for the last three octane determinations.

EXAMPLE 2

The blank run with no additive of Example 1 was repeated. The initial octane requirement was initially 91 RON. After 24 hours it was 94, after 48 hours 96, after 72 hours 98, after 119 hours 99, after 169 hours 100, after 191 hours 100. Therefore, engine No. I exhibited an average stabilized octane requirement of 99.7 RON for the last three octane determinations using the unmodified fuel.

EXAMPLE 3

Engine No. I was again used but in this experiment the test fuel contained 0.4 gram of cerous 2-ethylhexanoate per gallon. The octane requirement of the engine was initially 91 RON. At 24 hours it was 92, at 48 hours 94, at 72 hours 95, at 122 hours 96, at 170 hours 97, at 190 hours 98, and 97 after 200 hours, giving an average octane rating of 97.3 RON for the last three octane determinations. This experiment shows that the cerium 2-ethylhexanoate additive provides a significant suppression in the octane requirement increase.

EXAMPLE 4

Engine No. II was used with the same test fuel and no additive just as in Examples 1 and 2. The initial octane requirement was 89 RON. After 24 hours it was 92, after 48 hours 94, after 72 hours 95, after 126 hours 97, after 173 hours 97, and after 190 hours 98. Therefore, the average stabilized octane rating of engine No. II was 97.3 RON.

EXAMPLE 5

Example 4 was repeated using engine No. II except that sufficient manganese methylcyclopentadienyl tricarbonyl (MMT), to provide 0.125 gram of manganese per gallon, was added to the test gasoline. The initial octane requirement was 93 RON. After 24 hours it was 93, after 48 hours 96, after 72 hours 96, after 122 hours 98, after 170 hours 98 and after 190 hours 99. This represents an average stabilized octane requirement of 98.3 RON for the last three octane determinations. This experiment shows that MMT exhibits no suppression of the octane requirement increase.

EXAMPLE 6

Example 5 was repeated in engine No. II using the same concentration of the mangenese antiknock agent except that cerous 2-ethylhexanoate was also added in an amount sufficient to provide 0.4 gram per gallon of the test gasoline. The initial octane requirement of the engine was 89 RON. After 24 hours the octane requirement was 93, after 48 hours 94, after 61 hours 93, after 85 hours 93, after 133 hours 94, and after 190 hours 95. This represents an average stabilized octane requirement of 94 RON for the last three determinations, which is a substantial suppression of the octane requirement increase obtained in Examples 4 and 5.

EXAMPLE 7

The potential antiknock activity of the cerium carboxylate, when added to the same base gasoline as used in the preceding experiments, was evaluated in this experiment. Cerious 2-ethylhexanoate was added to the base fuel in an amount of 4.06 grams per gallon of the test fuel and the octane numbers by the motor method and the research method were obtained for comparison with the base fuel. The MON and RON for the base fuel were 83.7 and 91.2, respectively, and for the fuel containing this cerium additive were 82.8 and 91.0, respectively. This data demonstrates that this cerium additive has no measurable antiknock activity when added to a motor gasoline base stock.

EXAMPLE 8

The solubility of cerous octanoate in gasoline was evaluated by adding 0.051 gram of cerous octanoate to one pint of gasoline and shaking the mixture for one hour in a platform shaker at room temperature (20°–25° C.). The gasoline was a lead-free motor gasoline analyzing 25.5 percent aromatics, 8.5 percent olefins and 66 percent saturated paraffins. At the end of the one-hour period the gasoline sample was removed from the shaker and inspected. It was determined that this cerous octanoate was substantially insoluble in the gasoline. This experiment was repeated except that 0.0063 gram of cerous octanoate was added to one pint of the gasoline. Once again, following shaking, inspection showed that this cerous octanoate was substantially insoluble in the gasoline.

It is to be understood that the above disclosure is by way of specific example and that numerous modifications and variations are available to those of ordinary skill in the art without departing from the true spirit and scope of the invention.

We claim:

1. A gasoline motor fuel composition comprising a major amount of gasoline and in solution between about 0.05 and about ten grams of the cerium (III) or cerium (IV) salt of 2-ethylhexanoic acid per gallon of gasoline whereby the octane requirement increase of an internal combustion engine using the motor fuel composition is suppressed.

2. The gasoline motor fuel composition of claim 1 wherein the cerium salt is cerous 2-ethylhexanoate.

3. The gasoline motor fuel composition of claim 1 wherein the cerium (III) or cerium (IV) 2-ethylhexanoate is present in an amount between about 0.2 and about two grams per gallon of gasoline.

4. In a method of operating a gasoline powered internal combustion engine which exhibits a tendency of requiring progressively increasing octane fuel with use, the improvement which comprises combusting a gasoline in said internal combustion engine which contains in solution between about 0.05 and about ten grams of the cerium (III) or cerium (IV) salt of 2-ethylhexanoic acid per gallon of gasoline whereby the octane requirement increase of the internal combustion engine is suppressed.

5. A method of operating a gasoline powered internal combustion engine in accordance with claim 4 in which the cerium salt is cerous 2-ethylhexanoate.

6. In a method of operating a gasoline powered internal combustion engine in accordance with claim 4 wherein the cerium (III) or cerium (IV) 2-ethylhexanoate is present in an amount between about 0.2 and about two grams per gallon of gasoline.

* * * * *